US008220611B2

(12) United States Patent
Cost

(10) Patent No.: US 8,220,611 B2
(45) Date of Patent: Jul. 17, 2012

(54) CURRENCY MECHANISM RETENTION

(75) Inventor: Evan J. Cost, Audubon, PA (US)

(73) Assignee: MEI, Inc., West Chester, PA (US)

( * ) Notice: Subject to any disclaimer, the term of this patent is extended or adjusted under 35 U.S.C. 154(b) by 800 days.

(21) Appl. No.: 11/571,113

(22) PCT Filed: Jun. 15, 2005

(86) PCT No.: PCT/US2005/021322

§ 371 (c)(1),
(2), (4) Date: Jan. 11, 2008

(87) PCT Pub. No.: WO2006/012037

PCT Pub. Date: Feb. 2, 2006

(65) Prior Publication Data

US 2008/0185260 A1 Aug. 7, 2008

Related U.S. Application Data

(60) Provisional application No. 60/582,492, filed on Jun. 24, 2004.

(51) Int. Cl.
*B65D 45/32* (2006.01)
*G07F 9/10* (2006.01)

(52) U.S. Cl. ..... 194/350; 24/498

(58) Field of Classification Search ..... 194/350; 24/456–459, 494, 498, 499, 503, 504, 507, 24/571; 403/374.1, 374.2, 374.5, 409, 474.5, 403/FOR. 102; 52/127.11, 27, 36.1–36.6; 312/242, 245, 351.1; 361/725, 726, 747; 269/86, 165, 171.5, 194, 202; 248/680, 681, 248/535, 229.11

See application file for complete search history.

(56) References Cited

U.S. PATENT DOCUMENTS

| | | | | | |
|---|---|---|---|---|---|
| 629,679 | A | | 7/1899 | Guynes et al. | |
| 764,238 | A | * | 7/1904 | Hamilton | 24/498 |
| 2,584,955 | A | * | 2/1952 | Williams | 248/643 |
| 4,176,817 | A | * | 12/1979 | Jones | 248/313 |
| 4,355,793 | A | | 10/1982 | Juneau | |
| 5,031,956 | A | * | 7/1991 | Hudgins | 296/100.16 |
| 5,108,216 | A | * | 4/1992 | Geyer et al. | 403/330 |
| 5,131,516 | A | | 7/1992 | Clough | |
| 5,209,395 | A | * | 5/1993 | Zouzoulas et al. | 232/15 |
| 5,232,140 | A | | 8/1993 | Gregory et al. | |
| 5,277,412 | A | * | 1/1994 | Pringle | 269/47 |
| 5,515,959 | A | * | 5/1996 | Stephenson et al. | 194/206 |
| 5,647,102 | A | * | 7/1997 | Sterling, Jr. | 24/494 |
| 6,170,285 | B1 | * | 1/2001 | Huffman et al. | 62/448 |
| 6,546,881 | B1 | * | 4/2003 | Wiesner | 109/45 |
| 7,173,185 | B1 | * | 2/2007 | Cloran et al. | 174/58 |
| 2002/0066636 | A1 | * | 6/2002 | Saltsov et al. | 194/302 |
| 2005/0202879 | A1 | * | 9/2005 | Hussaini et al. | 463/47 |

* cited by examiner

*Primary Examiner* — Mark Beauchaine
(74) *Attorney, Agent, or Firm* — Pepper Hamilton LLP

(57) ABSTRACT

A system is disclosed for mounting currency mechanisms of various sizes and shapes in vending machines or the like. The system may allow for relatively simple installation and removal of currency mechanisms without the use of mounting screws. The system includes a mounting surface, a portion of which is adapted to mate with a first surface of a currency mechanism. A tab is extended from the mounting surface to engage an opening in the first surface of the currency mechanism. A retention device is coupled to the mounting surface and is manipulable to engage a second surface of the currency mechanism and to cooperate with the tab to grip the currency mechanism.

22 Claims, 8 Drawing Sheets

CURRENCY MECHANISM RETENTION

CROSS REFERENCE TO RELATED APPLICATIONS

This application is a national phase filing under 35 U.S.C. §371 of international application number PCT/US2005/021322, filed Jun. 15, 2005, which claims the benefit of priority of U.S. provisional application No. 60/582,492 filed Jun. 24, 2004. The disclosures of the prior applications are considered part of (and are incorporated by reference in) the disclosure of this application.

FIELD OF THE INVENTION

The disclosure relates to retention systems and, more particularly, to retention systems for currency mechanisms.

BACKGROUND

Vending machines, gaming machines and the like include currency mechanisms, such as bill collectors and coin validators. Typically, such currency mechanisms are fixed to their associated vending machines with one or more screws. In an exemplary installation, three screws might be used. Generally, a currency mechanism includes holes to accept those mounting screws, which may be tightened using a screwdriver or some other tool.

SUMMARY

A system is disclosed for mounting currency mechanisms of various sizes and shapes in vending machines and the like. The system may allow for relatively simple installation and removal of currency mechanisms without the use of mounting screws.

In one aspect, a currency mechanism retention system includes a mounting surface, a portion of which is adapted to receive a first surface of a currency mechanism. A tab extends from the mounting surface so as to engage an opening in the first surface of the currency mechanism. A retention device is coupled to the mounting surface. The retention device has a surface that is adjustably positionable to engage a second surface of the currency mechanism and to cooperate with the tab to grip the currency mechanism.

According to some implementations, the retention device includes a housing that is mountable to a mounting surface. A rack is coupled to the housing and is extendable an adjustable distance from the housing to contact a surface of the currency mechanism. A rotatable drive gear is within the housing and is positionable to engage the rack so that, upon rotation of the drive gear, the rack is displaced linearly.

In some implementations, the retention device includes a lever that can be attached to a mounting surface so that it can pivot about an axis. The lever includes an engagement section that is adapted to engage a surface of the currency mechanism. The engagement section may include a surface defining a stepped cam. The engagement section may be positioned so that one of the cams engages a surface of a currency mechanism. A return spring can be attached between the mounting surface and the lever so as to bias the lever toward a position of engagement with a currency mechanism.

In another aspect, a method of mounting a currency mechanism having one of various sizes is disclosed. In one implementation, the method includes using a serration on a stepped cam to engage a surface of the currency mechanism. In another implementation, the method includes providing a housing with a rack whose position relative to the housing is adjustable and adjusting the rack to engage a surface of the currency mechanism.

In another aspect, a method of coupling a currency mechanism to a mounting surface includes coupling a retention device to a mounting surface at a position that is adjacent to a currency mechanism holding area. The method includes positioning a currency mechanism in the currency mechanism holding area so that a tab, extending from the mounting surface, mates with an opening at a first surface of the currency mechanism. The method also includes manipulating the retention device to engage a second surface of the currency mechanism so that it cooperates with the tab to grip the currency mechanism.

In some implementations, manipulating the retention device includes rotating a knob exposed on the retention device to advance a rack from the retention device toward the currency mechanism retention area. In another implementation, manipulating the retention device includes causing the retention device to pivot about an axis so that a serration on the retention device engages the second surface of the currency mechanism.

In some implementations, one or more of the following advantages may be present.

The need to use mounting screws to fix a currency mechanism in place may be eliminated. Accordingly, problems associated with the use of screws for mounting currency mechanism may be overcome. Those problems include, for example, misplacing screws during installation, maintenance or replacement of a currency mechanism and accidentally stripping screws when installing the currency mechanisms. Additionally, the need for tools, such as screwdrivers, to install or remove a currency mechanism from a vending machine, may be eliminated.

Currency mechanisms may be made smaller and more simply because provisions to accept mounting screws may be eliminated. Smaller, simpler construction may result in a corresponding reduction in manufacturing and material costs associated with the currency mechanism.

A single retention device may be used to accommodate currency mechanisms having various sizes and shapes.

Other features or advantages will be apparent from the following description, drawings and claims.

BRIEF DESCRIPTION OF THE DRAWINGS

Like reference numerals refer to similar elements.

DETAILED DESCRIPTION

Figure 1:
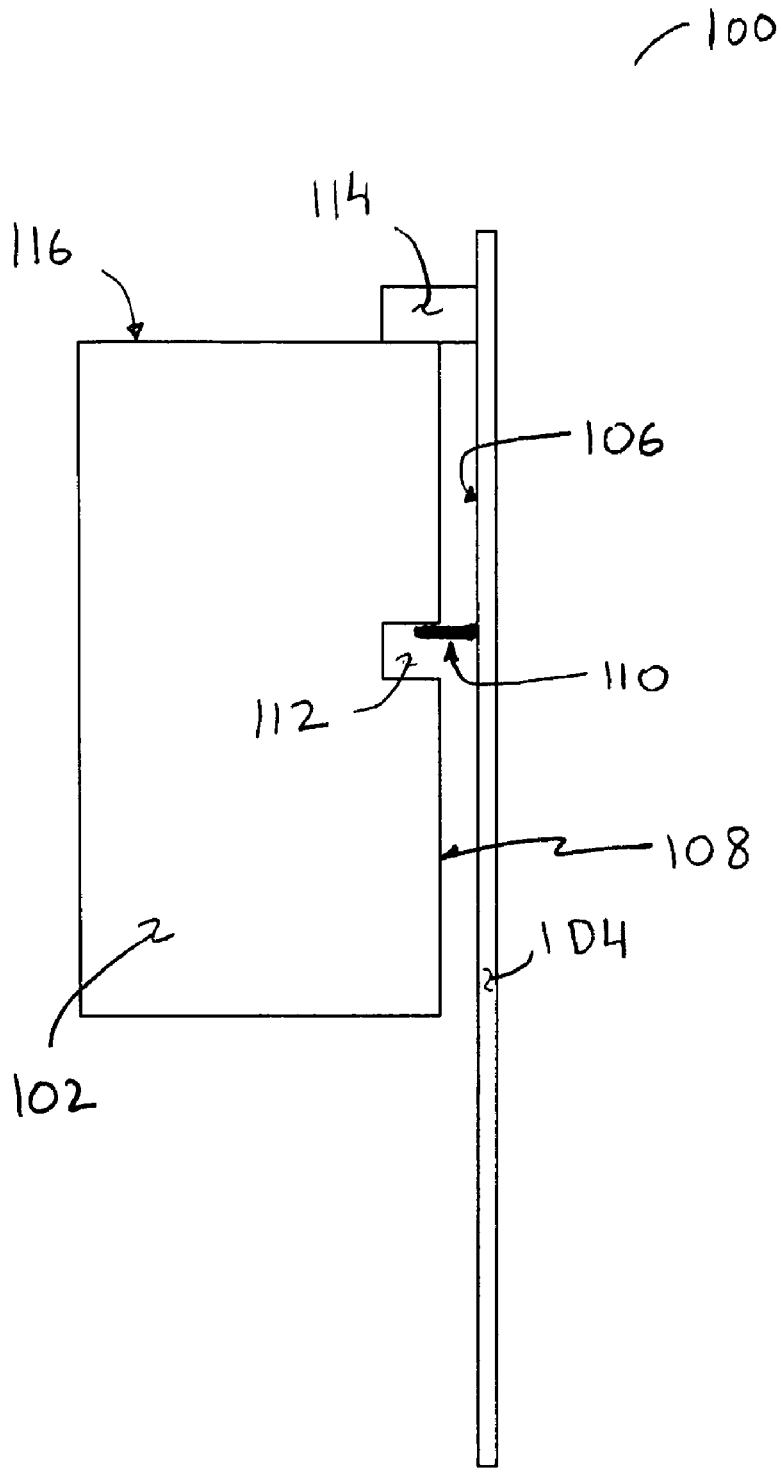
FIG. 1 is a side view of a system for retaining a currency mechanism.

FIG. 1 illustrates a system 100 for retaining a currency mechanism 102 in a vending machine, gaming machine or the like. In various implementations, the currency mechanism 102 may include, for example, a bill collector, a coin validator or other currency handling device. The illustrated system 100 includes a mounting surface 104, a portion 106 of which is adapted to receive a first surface 108 of the currency mechanism 102. A tab 110 extends from the mounting surface 104 to engage an opening 112 in the first surface 108 of the currency mechanism 102. A retention device 114 is coupled to the mounting surface 104 at a position that is adjacent to the portion 106 of the plate 104 adapted to receive the rear surface 108 of the currency mechanism. The retention device 114 includes a surface whose position can be adjusted to engage a second surface 116 of the currency mechanism 102 and to cooperate with the tab 110 to grip the currency mechanism 102. According to the illustrated implementation, the first surface 108 of the currency mechanism 102 is a rear surface and the second surface 116 of the currency mechanism 102 is an upper surface. The illustrated currency mechanism 102 is positioned in a currency mechanism holding area.

Figure 2:
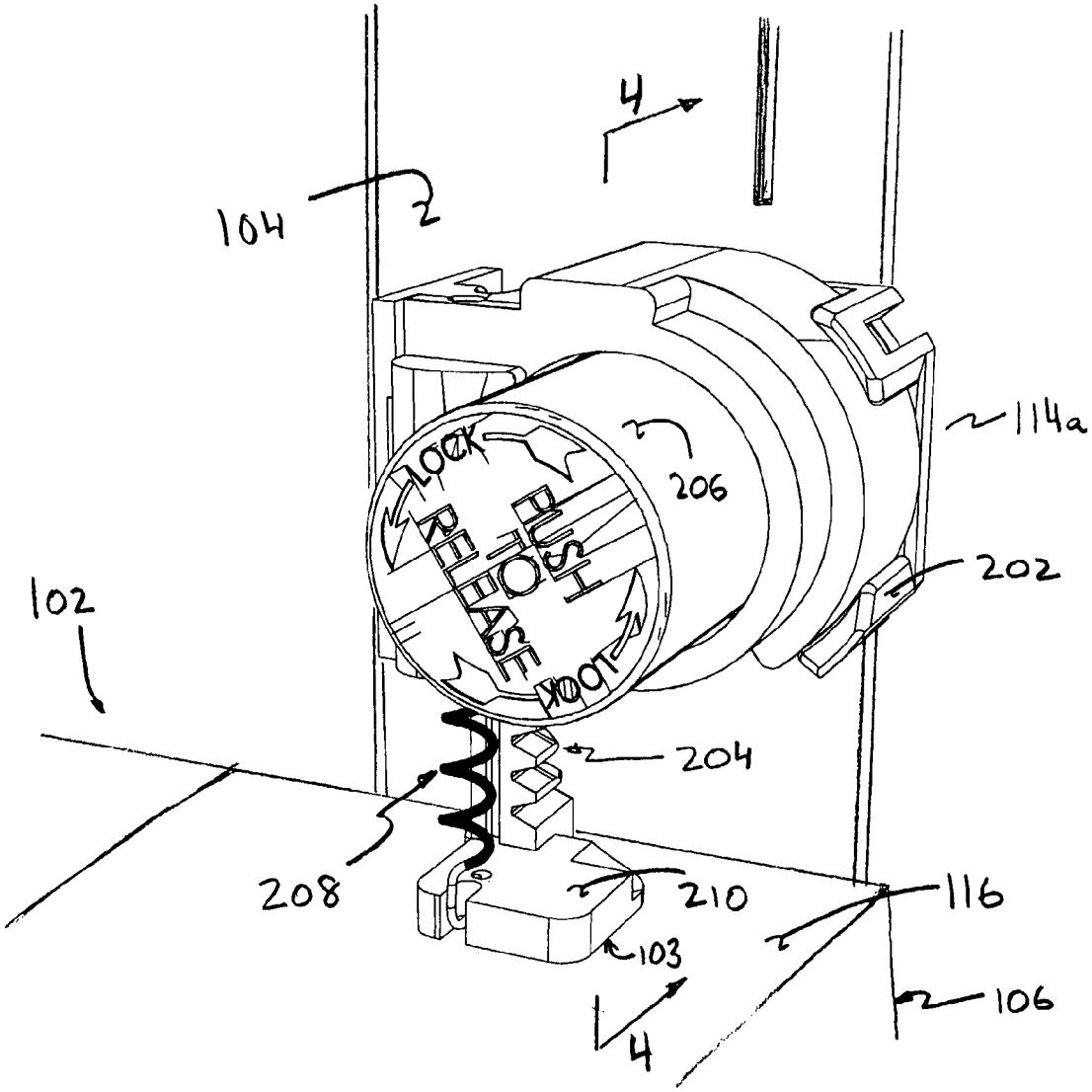
FIG. 2 is a perspective view of a retention device.

FIG. 2 illustrates one implementation of a retention device 114*a* that includes a surface 103 whose position can be adjusted so as to engage a second surface 116 of a currency mechanism 102 and to cooperate with a tab (e.g. 110 of FIG. 1) to grip the currency mechanism. The illustrated retention device 114*a* includes a housing 202 that is coupled to a mounting surface 104. The housing 202 is positioned on the mounting surface 104 adjacent the portion 106 of the mounting surface 104 adapted to receive the rear surface of the currency mechanism 102.

A rack 204 is coupled to the housing 202 and extends from the housing 202 toward the currency mechanism 102 (in the illustrated implementation, that direction is downward). The distance that the rack 204 extends from the housing 202 is manually adjustable. In a typical installation, the rack 204 extends from the housing 202 so that surface 103 contacts the second surface 116 of the currency mechanism 102. In the illustrated implementation, a base 210 is coupled to a far end of the rack 204. The bottom surface of the base 210 whose position can be adjusted to contact the second surface 116 of the currency mechanism 102.

A rack spring 208 is coupled to the base 210 at one end and is coupled to the housing 202 at an opposite end (not visible) inside the housing. The spring 208 is adapted to urge the rack 204 (and base 210) to a retracted position relative to the housing 202.

A knob 206 is exposed through the housing 202 for manipulation by an operator. In one implementation, by manipulating the knob 206, an operator can manually adjust the distance from the housing 202 that the rack 204 extends or can cause the rack 204 to spring axially inward to a retracted position relative to the housing 202. According to one implementation, the knob 206 is adapted to be rotated and/or pushed in toward the housing 202 in an axial direction. If the operator rotates the knob 206, the rack 204 moves outward from the housing 202 (i.e., downward in the illustrated implementation). Once extended, the rack 204 resists being pushed back in toward the housing 202. If, however, with the rack 204 in an extended position relative to the housing 202, the operator pushes the knob 206 in, the rack 204 springs back into the housing 202 by a force exerted on the rack 204 by the spring 208.

Figure 3:
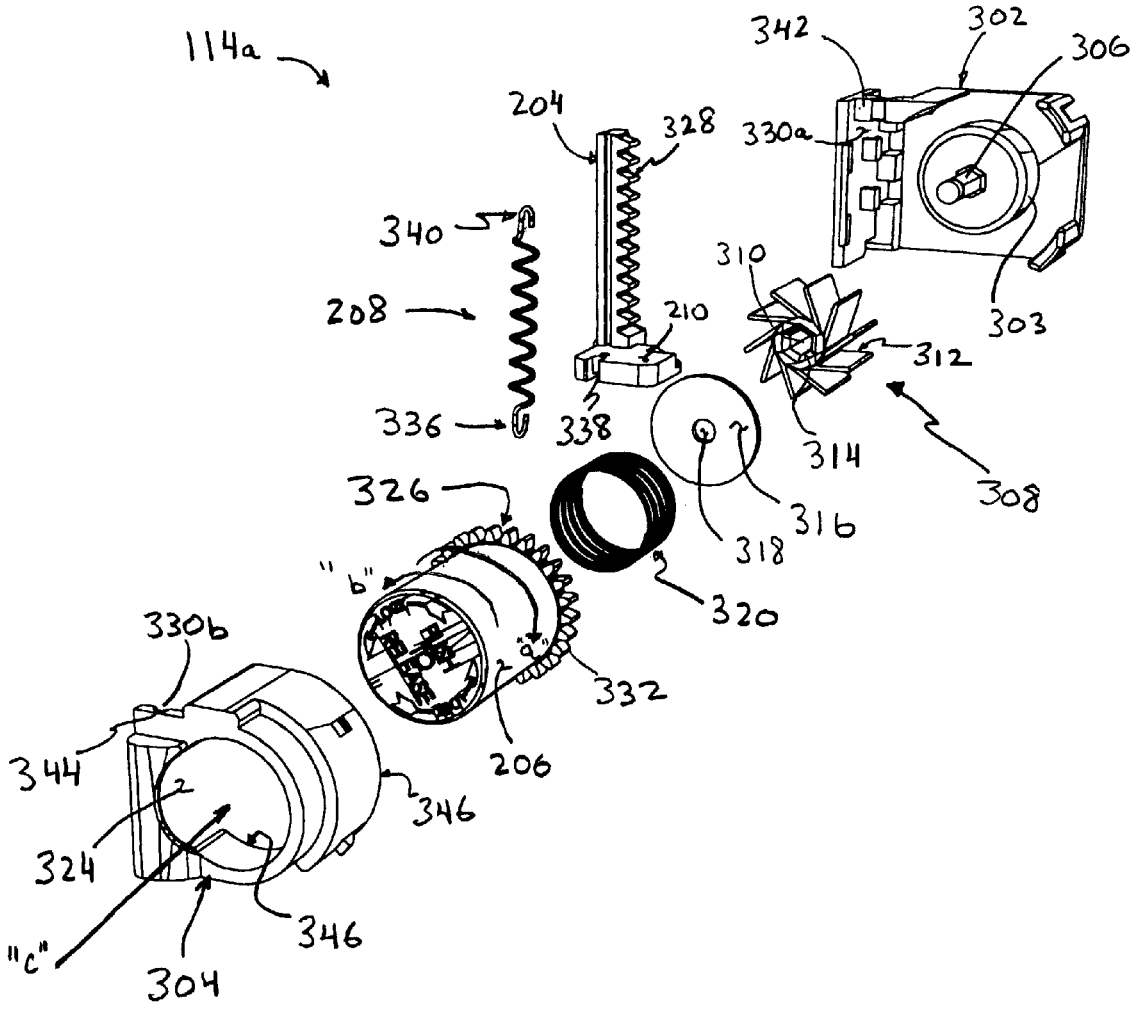
FIG. 3 is an exploded view of a retention device.

FIG. 3 illustrates an exploded perspective view of retention device 114*a*. The illustrated implementation includes a housing with a base 302 and a cover 304. The base 302 is adapted to be fixed to a mounting surface (e.g., mounting surface 104 of FIGS. 1 and 2). The base 302 includes an approximately cylindrical stage 303 that extends from the base 302 in an approximately axial direction outward. A shaft 306 extends from an approximate center point of the stage 302, also in an axially outward direction. A portion of the shaft 306 is hexagonal in cross section. The far end of the shaft 306 is circular in cross section.

The illustrated implementation includes a rack 204 that can be positioned partially within a side compartment of the housing 202. The side comportment is defined by side portions 330*a*, 330*b* of the base 302 and the cover 304, respectively. The rack 204 is a substantially straight element that includes a surface with gear teeth 328. When assembled, the gear teeth 328 face substantially toward the pawl 308. A base 210 is coupled to a lower end of the rack 204. The base 210 and a portion of the lower end of the rack 204 extend through an opening in a bottom surface of the housing in a downward direction. The rack 204 is movable in an axial direction (i.e. up and down) so that the distance it extends from the housing can be varied.

A rack spring 208 is adapted to be coupled at one end 336 to a lower portion 338 of the rack 204. An opposite end 340 of the rack spring 334 is adapted to be coupled to the housing (e.g. at point 342 or 344). The rack spring 334 is adapted to urge the rack 204 toward a retracted position relative to the housing. Accordingly, if the rack 204 is moved out from the housing, the spring urges it back into a retracted position.

A pawl 308 is positioned adjacent the stage 303 and includes an approximately cylindrical body 314 with an axial opening 310 that is adapted to receive shaft 306. The axial opening 310 has a hexagonal cross section that is sized to mate snugly with the hexagonal portion of shaft 306. Once mated to the shaft 306, the pawl 308 is prevented from rotating about the axis of shaft 306. The pawl 308 includes several flexible fingers 312 that extend outward from its cylindrical body 314 at approximately regular intervals about the circumference of the cylindrical body 314. Each flexible finger 312 extends in a direction that is approximately tangential to the circumference of its cylindrical body and in the same direction (i.e., either clockwise or counter clockwise) as the other flexible fingers 312.

A washer 314 is positioned adjacent the pawl 308 and includes an opening 318 adapted to receive the circular far end of the shaft 306. The washer 314 may be secured to the far end of the shaft 306 using conventional techniques.

A knob 206 is positioned to extend through an opening 324 in the cover 304 portion of the housing. The knob 206 is thereby exposed through the housing for manipulation by an operator. When assembled, the gear teeth 328 on the knob 328 can contact a lip 346 on the cover 304. A knob spring 320 is positioned between the washer 316 and the knob 206 and is adapted to urge the knob 206 in a direction away from the washer 316 (i.e., to a fully extended position through opening 324). The knob 206 has an approximately cylindrical opening (not shown) that, when assembled, receives the knob spring 320, the washer 316 and the pawl 308.

A rotatable drive gear 326 is formed on an outer surface of the knob 206 and includes gear teeth 332 adapted to engage with the gear teeth 328 on rack 204. When the knob 206 is fully extended through the opening 324, the gear teeth 332 on the rotatable drive gear 326 engage the gear teeth 328 on the rack 204 such that rotation of the knob in a counterclockwise direction causes the rack 204 to move in a downward direction out of the housing to an extended position.

A portion of the inner cylindrical surface of the knob 206 includes a plurality of serrations (not shown in FIG. 3), which are adapted to engage with the fingers 312 of the pawl 308. Such engagement effectively prevents the knob 206 from rotating in one direction (i.e., clockwise as indicated by arrow "a"), but permits the knob 206 to rotate in an opposite direction (i.e., counterclockwise as indicated by arrow "b"). Therefore, if the rack 204 is in an extended position it may be prevented from being pushed back toward the housing by an engagement between the serrations on the inner surface of the knob 206 and the fingers 312 of the pawl 308.

Once assembled, the knob 206 is movable by an operator in an axial direction (indicated by arrow "c") toward the base 302. When the knob 206 is moved in that manner, the knob spring 320 is compressed against the washer 316. Also, as the knob 206 is moved, the knob 206 slides over the stage 303 so that an opening (not shown) in the knob 206 receives a portion of the stage 303. As the knob 206 is moved, the rotatable drive gear 326 also moves toward the base 302. The gear teeth 332 of the rotatable drive gear 326 slide off and disengage from the gear teeth 328 of the rack 204. When the two sets of gear teeth 332 and 328 are disengaged from each other, the rack 204 can spring to a retracted position relative to the housing under a force applied by the rack spring 334.

Figure 4:
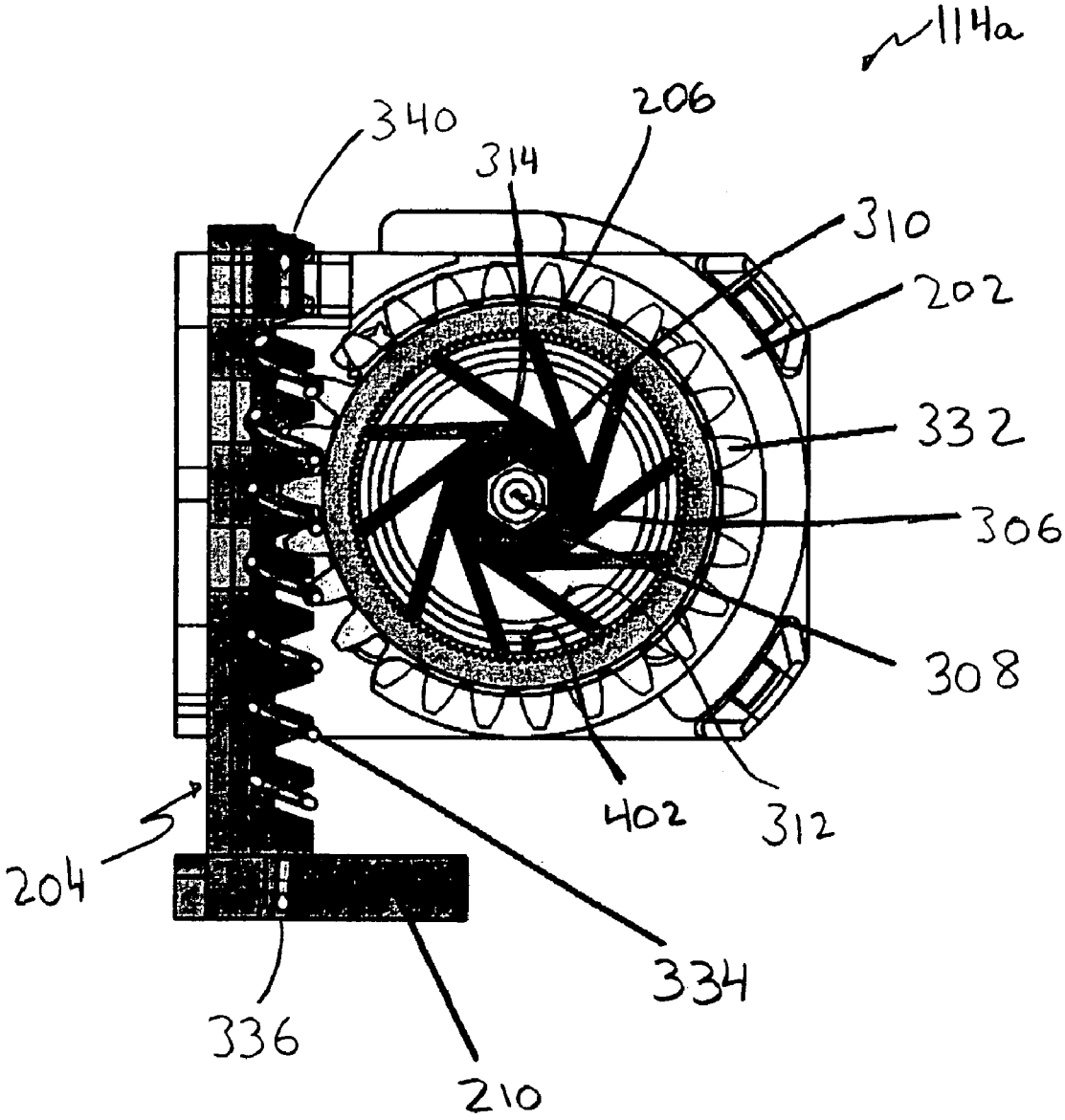
FIG. 4 is a cutaway view of a retention device.

FIG. 4 illustrates an assembled cross-section of the retention device 114*a* of FIG. 2, taken along lines 4-4. According to the illustrated implementation, the knob 206 is hollow. An inner circumferential surface of the knob 206 includes a plurality of serrations 402. The pawl 308 is positioned inside the knob 206 and is adapted to engage the serrations on the inner surface of the knob. The pawl includes an approximately cylindrical body 314 with an axial opening 310 that is adapted to receive shaft 306. The axial opening 310 has a hexagonal cross section that is sized to mate snugly with a hexagonal portion of the shaft 306. Once mated to the shaft 306, the pawl 308 is prevented from rotating about the axis of shaft 306.

The pawl 308 includes flexible fingers 312 that extend outward from its cylindrical body 314 at approximately regular intervals about the circumference of its cylindrical body 314. Each flexible finger 312 extends in direction that is approximately tangential to the circumference and in the same direction (i.e., either clockwise or counter clockwise) as the other flexible fingers 312. Each flexible finger 312 is adapted to resist deformation from compressive forces applied in an axial direction, but each flexible finger also is adapted to flex a small amount to allow the far tip of each flexible finger 312 to move a small amount toward the cylindrical body 314.

According to the illustrated implementation, the pawl inhibits rotation of the knob 206 and rotatable drive gear 326 in a clockwise direction, but allows rotation of the knob 206 and rotatable drive gear 326 in a counterclockwise direction. Accordingly, if an operator rotates the knob 206 and rotatable drive gear 326 in a counterclockwise direction the rack is moved downward by virtue of the mating of the two sets of gear teeth 328 and 332. However, if that operator attempts to rotate the knob 206 and rotatable drive gear 326 in a counterclockwise direction, the operator will be inhibited from doing so, because the pawl 308 is engaged with the serrations 402 inside the knob 206. In order to the move the rack to a position that is retracted into the housing 202, the knob 206 may be slid in toward the page, so that the gear teeth 332 on the knob 206 disengage from the gear teeth 328 of the rack 204. Once disengaged, the rack spring 334 draws the rack 204 in toward the housing.

Figure 5:
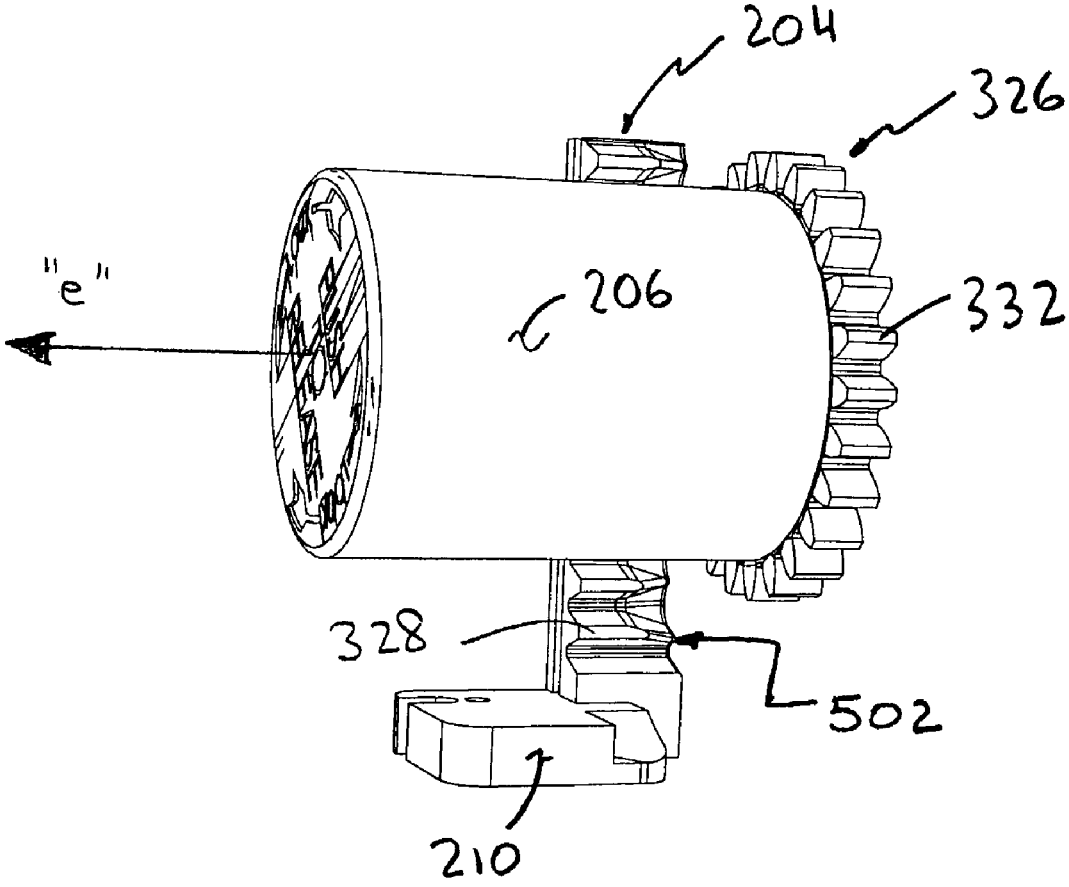
FIG. 5 is a side view of part of a retention device.

FIG. 5 illustrates a side perspective view of a knob 206 and a rack 204 positioned relative to each other so as to be disengaged from each other. The illustrated figure is intended to show the relative positions of the two elements 204 and 206 when the knob 206 is pushed in. For clarity, other elements have been omitted from FIG. 5. The side 502 of the rack's gear teeth 328 that faces the gear teeth 332 of the rotatable drive gear 326 is approximately wedge-shaped, with a pointed end of the wedge facing the gear teeth 332 of the rotatable drive gear 326. The wedge-shaped portion of the gear teeth 328 facilitates the meshing of the two gear sets when they come together (i.e., when the knob 206 moves in a direction indicated by arrow "e").

Figure 6:
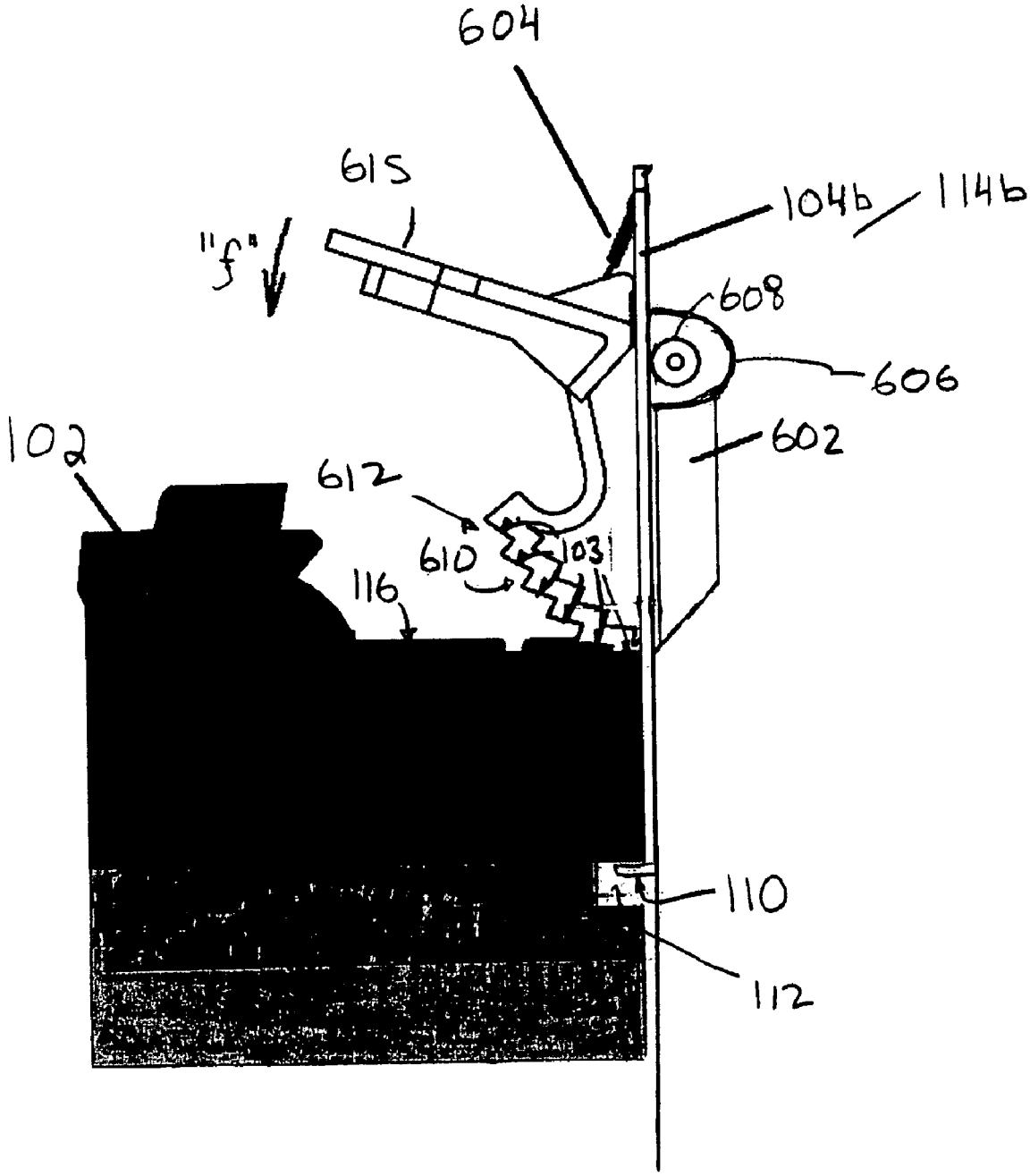
FIG. 6 is a side view of a system for retaining a currency mechanism.

FIG. 6 illustrates a second implementation of a retention device 114*b* that includes multiple surfaces 103 whose positions can be adjusted to engage a second surface 116 of a currency mechanism 102 and to cooperate with tab 110 to grip the currency mechanism 102. The illustrated retention device 114*b* includes a lever 602 that is pivotally coupled to a mounting surface 104*b* and a return spring 604 coupled to the mounting surface 104*b* and to the lever 602. The return spring 604 is adapted to bias the lever 602 toward a currency mechanism retaining position (which is the position shown in FIG. 6). The mounting surface 104*b* includes an aperture (not shown), through which the lever 602 can pass through at least partially.

A support element 606 is provided to hold a shaft 608 of the retention device 114*b*. The shaft 608 is held in such a manner that it can pivot about an axis of rotation located at the center of the shaft 608. As the lever 602 pivots in the direction indicated by arrow "f", a portion of the lever 602 moves through the aperture in the mounting surface 602. According to the illustrated implementation, the pivot axis is located on a side of the mounting surface 104*b* opposite the side where the currency mechanism 102 is installed.

The illustrated lever 602 includes an engagement section 610 that is adapted to engage the second surface 116 of the currency mechanism 102. The engagement section 610 includes a serrations 612 arranged along a curved surface. The curved surface follows an arc that varies in distance from the pivot axis of the lever 602. The serrations 612 near the upper end of the arc are closer in distance to the pivot axis than the serrations 612 near the lower end of the arc. Each serration 612 includes a surface 103 adapted to contact a second surface 116 of a currency mechanism 102. Depending on the size of the currency mechanism 102 to be retained, a different one of the surfaces 103 may be engaged.

According to the illustrated implementation, the lever 602 can be pivoted to position one of the surfaces 103 so that it is substantially horizontal and close to the plane of the mounting surface 104*b* when the surface 103 engages the second surface 116 of a currency mechanism 102.

According to the illustrated implementation, the lever 602 includes a handle 615 that extends away from the pivot axis. An operator can manipulate the handle 615 so that, if a currency mechanism 102 is engaged (as shown in FIG. 6) and the operator pushes the lever in a direction indicated by arrow "f", the lever 602 will rotate about its axis of rotation in the direction indicated by "f" and release the currency mechanism 102 from its engagement.

Figure 7:
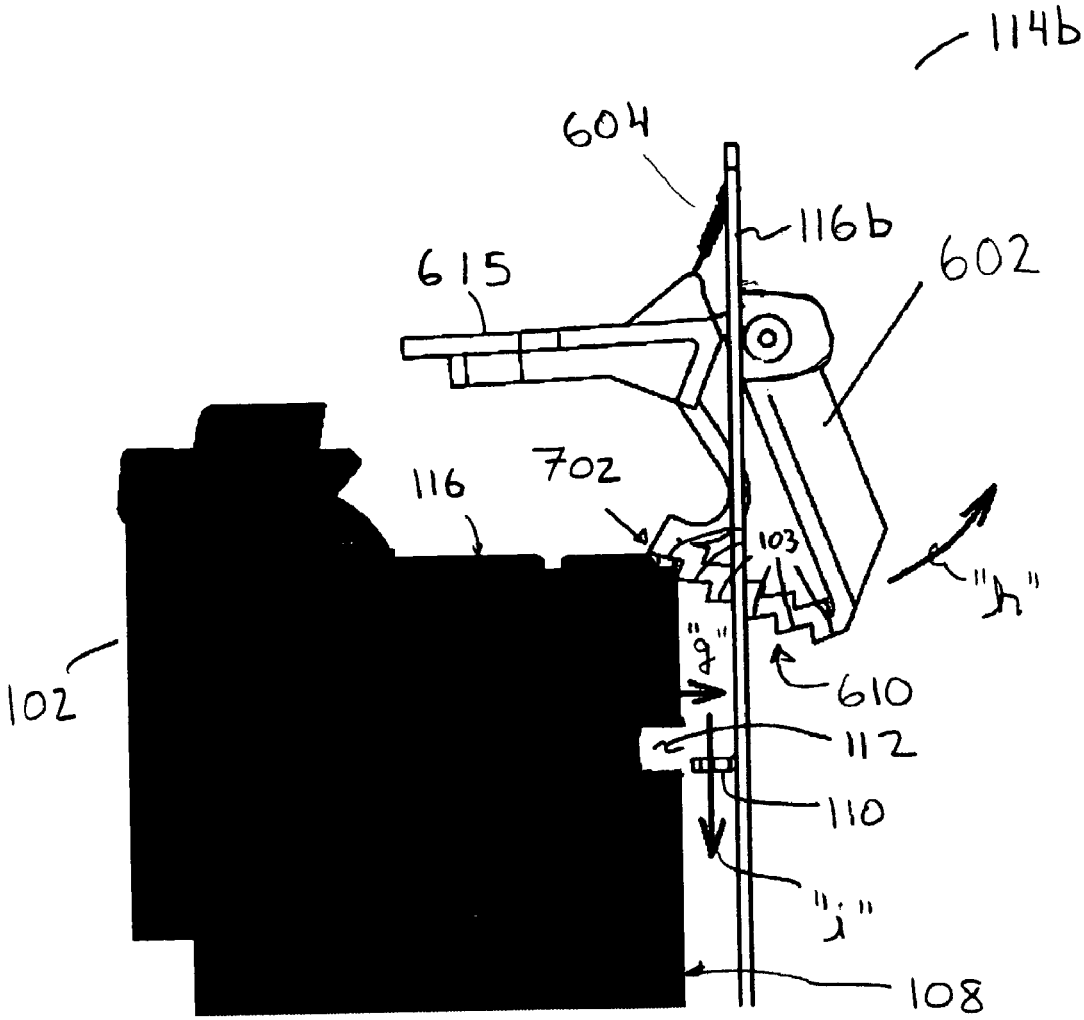
FIG. 7 is a side view of a system for retaining a currency mechanism.

FIG. 7 illustrates a currency mechanism 102 being coupled to a mounting surface 104*b* with retention device 114*b*. The tab 110 extends from the mounting surface 104 to engage an opening 112 in a first surface 108 of the currency mechanism 102. An upper rear corner 702 of the currency mechanism 102 is engaged with an upper serration 612 on the engagement section 610 of the lever 114*b*. Moving the currency mechanism 102 toward the mounting surface 104*b* (in a direction indicated by arrow "g") causes the lever 114*b* to pivot about its axis (in a direction indicated by arrow "h"). If the currency mechanism is moved in a downward direction (indicated by arrow "i"), the upper rear corner 702 of the currency mechanism may slip off of the upper serration 612 onto a serration 612 just below the upper serration 612. If the currency mechanism 102 is moved even farther downward, the upper rear corner 702 of the currency mechanism 102 may slip down to an even lower serration 612.

As the currency mechanism 102 is being moved into place against the mounting surface 104*b*, the lever 114*b* is urged to pivot in a direction opposite arrow "h" by the return spring 604. Once the currency mechanism 102 is in place against the mounting surface 104*b* and it is resting on tab 110, which is engaged with the opening 112 in the first surface of the currency mechanism 102, the lever 114*b* is urged to a position as far forward as possible (i.e. rotated in the direction opposite arrow "h" as far as it can be). With the lever 114*b* in that position, a surface 103 of one of the serrations 612 will be in contact with the upper surface of the currency mechanism 102. That surface 103 exerts a downward force on the currency mechanism 102, effectively cooperating with the tab 110 to grip the currency mechanism 102.

Figure 8:
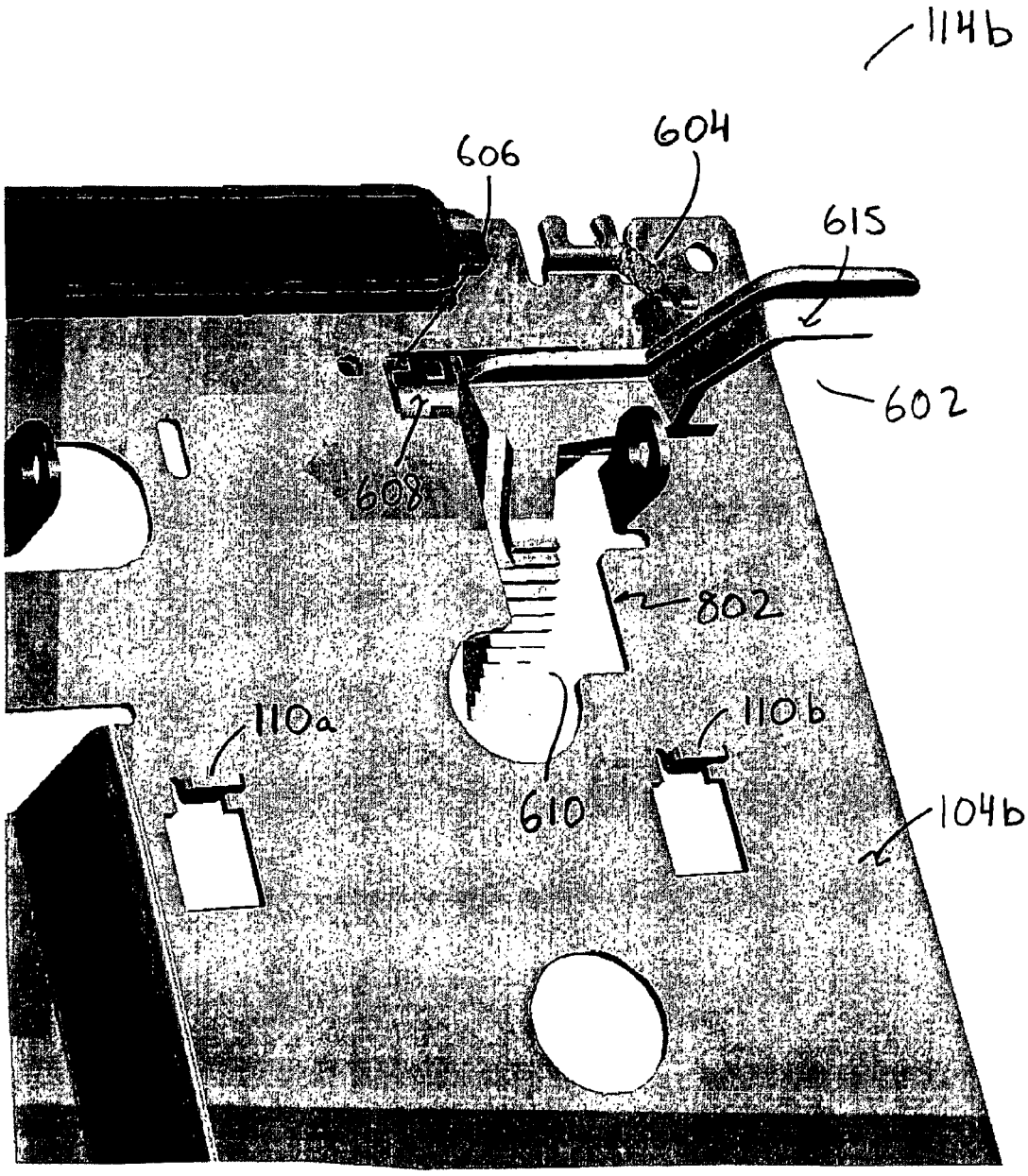
FIG. 8 is a perspective view of part of a retention device.

FIG. 8 illustrates a perspective view of a retention device 114*b* mated to a mounting surface 104*b*. The mounting surface 104*b* includes an aperture 802, through which the lever 602 can swing at least partially through. Two tabs 110*a*, 110*b* are provided to engage respective openings (e.g. opening 112 in FIG. 1) in a currency mechanism (not shown). The shaft 608 of the lever 602 is held in place by a support element 606. The shaft 608 is held in a manner that allows the lever 602 to pivot thereabout. The lever 602 also includes a handle 615 that extends away from the pivot axis.

A number of implementations have been described. Nevertheless, various modifications may be made without departing from the spirit and scope of the invention.

For example, the rack spring could be adapted to urge the rack toward a fully extended position relative to the housing. In that implementation, it is possible that pushing the knob inward could release the rack so that it springs to a fully extended position with the base in contact with an upper surface of the currency acceptor. The knob may be adapted to draw the extended rack back into the housing when it is operated. As another example, different mechanisms (other than turning and pushing a knob) may be used to cause the rack to extend and retract relative to the housing.

Additionally, the rack may be adapted to be driven by a small motor, which may be controlled by an operator who manipulates a control switch to cause the rack to retract or extend.

Various modifications of the lever design are possible. For example, the engagement section of the lever may include a greater or lesser number of serrations, the physical size of each serration may be varied, and the handle may be shorter or longer. The lever may be coupled to the mounting surface by a hinged connection or any other connection that allows the lever to pivot about an axis.

The physical arrangement of the various components may be modified in numerous ways. For example, the retention device may be permanently coupled to the mounting surface. The retention device may be mounted on any of the four sides of the currency mechanism.

Additionally, the disclosed techniques and devices may be adapted to secure various different types of components to mounting surfaces. Examples of such components include receipt acceptors and parking ticket acceptors.

Accordingly, other implementations are within the scope of the following claims.

What is claimed is:

1. A currency mechanism retention system comprising:

a mounting surface, a portion of which is adapted to receive a first surface of a currency mechanism;

a tab extended from the mounting surface to engage an opening in the first surface of the currency mechanism; and a retention device coupled to the mounting surface, wherein the retention device comprises:

a plurality of surfaces, each corresponding to a different height, and whose position is adjustable such that at least one of said plurality of surfaces can engage a second surface of the currency mechanism and to cooperate with the tab to grip the currency mechanism such that the second surface of the currency mechanism is substantially perpendicular to the mounting surface;

a lever that is pivotally coupled to the mounting surface, wherein the lever is pivotable in a plane substantially perpendicular to a plane of the mounting surface; and a return spring coupled to the mounting surface and to the lever, wherein the return spring is adapted to bias the lever toward a currency mechanism retaining position.

2. The currency mechanism retention system of claim 1 wherein the mounting surface includes an aperture and wherein the lever is adapted to pass at least partially through the aperture.

3. The currency mechanism retention system of claim 2 wherein a portion of the lever is adapted to move through the aperture as the lever pivots about an axis.

4. The currency mechanism retention system of claim 3 wherein the axis is located on a side of the mounting surface opposite the portion adapted to mate with the currency mechanism.

5. The currency mechanism retention system of claim 1 wherein the lever comprises an engagement section adapted to engage the second surface of the currency mechanism.

6. The currency mechanism retention system of claim 5 wherein the engagement section comprises serrations arranged along a curved surface.

7. The currency mechanism retention system of claim 6 wherein the curved surface follows an arc that varies in distance from the pivot axis of the lever.

8. The currency mechanism retention system of claim 6 wherein a serration at an upper section of the arc is closer to the pivot axis than a serration at a lower end of the arc.

9. The currency mechanism retention system of claim 6 wherein each serration includes a mating surface adapted to engage the second surface of the currency mechanism.

10. The currency mechanism retention system of claim 6 wherein each serration is adapted to engage the second surface of differently sized currency mechanism, respectively.

11. A currency mechanism retention device comprising:

a lever that is pivotally attached to a mounting surface so as to extend at least partially through an aperture in the mounting surface such that the lever is pivotable in a plane substantially perpendicular to a plane of the mounting surface, wherein the lever comprises an engagement section comprising a plurality of surfaces, each corresponding to a different height, and whose position is adjustable such that at least one of said plurality of surfaces can engage a surface of the currency mechanism and to cooperate with a tab to grip the currency mechanism; and a return spring attached to the mounting surface and to the lever, the return spring attached to bias the lever toward a currency mechanism retaining position.

12. The currency mechanism retention device of claim 11 wherein the lever is rotatable so as to pass at least partially through the aperture.

13. The currency mechanism retention device of claim 11 wherein the lever is rotatable so that a portion of the lever can move through the aperture as the lever pivots about an axis.

14. The currency mechanism retention device of claim 13 wherein the axis is located on a side of the mounting surface opposite a side that is adapted to mate with the currency mechanism.

15. The currency mechanism retention device of claim 11 wherein the engagement section comprises a plurality of serrations arranged along a curved surface.

16. The currency mechanism retention device of claim 15 wherein the curved surface follows an arc that varies in distance from the pivot axis of the lever.

17. The currency mechanism retention device of claim 16 wherein a serration at an upper section of the arc is closer to the pivot axis than a serration at a lower end of the arc.

18. The currency mechanism retention device of claim 15 wherein each serration includes a mating surface adapted to engage the surface of the currency mechanism.

19. A method of mounting a currency mechanism, the method comprising:

coupling a retention device to a mounting surface at a position that is adjacent to a currency mechanism holding area;

positioning a currency mechanism in the currency mechanism holding area so that a tab extending from the mounting surface mates with an opening at a first surface of the currency mechanism; and adjusting a position of a plurality of substantially planar surfaces, each substantially planar surface corresponding to a different height, of the retention device so that at least one of the substantially planar surfaces can engage a second surface of the currency mechanism and cooperate with the tab to grip the currency mechanism such that the second surface of the currency mechanism is substantially perpendicular to the mounting surface.

20. A method of mounting a currency mechanism, the method comprising:

coupling a retention device to a mounting surface at a position that is adjacent to a currency mechanism holding area;

positioning a currency mechanism in the currency mechanism holding area so that a tab extending from the mounting surface mates with an opening at a first surface of the currency mechanism; and manipulating the retention device to engage a second surface of the currency mechanism and to cooperate with the tab to grip the currency mechanism such that the second surface of the currency mechanism is substantially perpendicular to the mounting surface, wherein the retention device comprises a lever that is pivotally coupled to the mounting surface and wherein the mounting surface includes an aperture through which the lever is adapted to pass at least partially, wherein manipulating the retention device comprises causing the lever to pivot in a plane substantially perpendicular to plane of the mounting surface so that at least one of a plurality of serrations, each serration corresponding to a different height, on the retention device engages the second surface of the currency mechanism.

21. A currency mechanism retention system comprising:

a mounting surface, a portion of which is adapted to receive a first surface of a currency mechanism;

a tab extended from the mounting surface to engage an opening in the first surface of the currency mechanism; and a retention device coupled to the mounting surface;

wherein the retention device comprises a plurality of surfaces, each corresponding to a different height, and whose position is adjustable such that at least one of said plurality of surfaces can engage a second surface of a currency mechanism, and to cooperate with the tab to grip the currency mechanism such that the second surface of the currency mechanism is substantially perpendicular to the mounting surface.

22. The currency mechanism retention system of claim 21 wherein the first surface of the currency mechanism is a rear surface and wherein the second surface of the currency mechanism is an upper surface.

* * * * *